United States Patent [19]

Mathis

[11] 4,418,248

[45] Nov. 29, 1983

[54] DUAL ELEMENT HEADPHONE

[75] Inventor: Terry D. Mathis, Thiensville, Wis.

[73] Assignee: Koss Corporation, Milwaukee, Wis.

[21] Appl. No.: 329,763

[22] Filed: Dec. 11, 1981

[51] Int. Cl.[3] ..... H04R 1/28; H04R 1/22

[52] U.S. Cl. ..... 179/156 R; 179/115.5 PS; 179/110 A

[58] Field of Search ..... 179/156 R, 156 A, 115.5 PS, 179/110 A, 111 E

[56] References Cited

U.S. PATENT DOCUMENTS

| | | | |
|---|---|---|---|
| 3,786,202 | 1/1974 | Schafft | 179/110 A |
| 3,819,879 | 6/1974 | Baechtold | 179/179 |
| 3,943,304 | 3/1976 | Piribauer | 179/111 E |
| 3,984,636 | 10/1976 | Turner | 179/156 R |
| 4,005,278 | 1/1977 | Görike | 179/181 R |
| 4,024,355 | 5/1977 | Takahashi | 179/110 A |
| 4,283,606 | 8/1981 | Buck | 179/115.5 H |
| 4,292,561 | 9/1981 | Martin | 179/110 A |

OTHER PUBLICATIONS

Excellence in Design, Reprinted from DESIGN NEWS, Nov. 2, 1981.

*Primary Examiner*—G. Z. Rubinson
*Assistant Examiner*—Danita R. Byrd
*Attorney, Agent, or Firm*—Quarles & Brady

[57] ABSTRACT

A stereophone includes cup assemblies which are supported over the ears of a user by a headband. Each cup assembly includes a piezoelectric acoustic transducer and a dynamic acoustic transducer. The reproduction of the entire audio spectrum is divided between the two transducers at a crossover frequency which is established by an acoustic filter.

3 Claims, 4 Drawing Figures

FIG.1
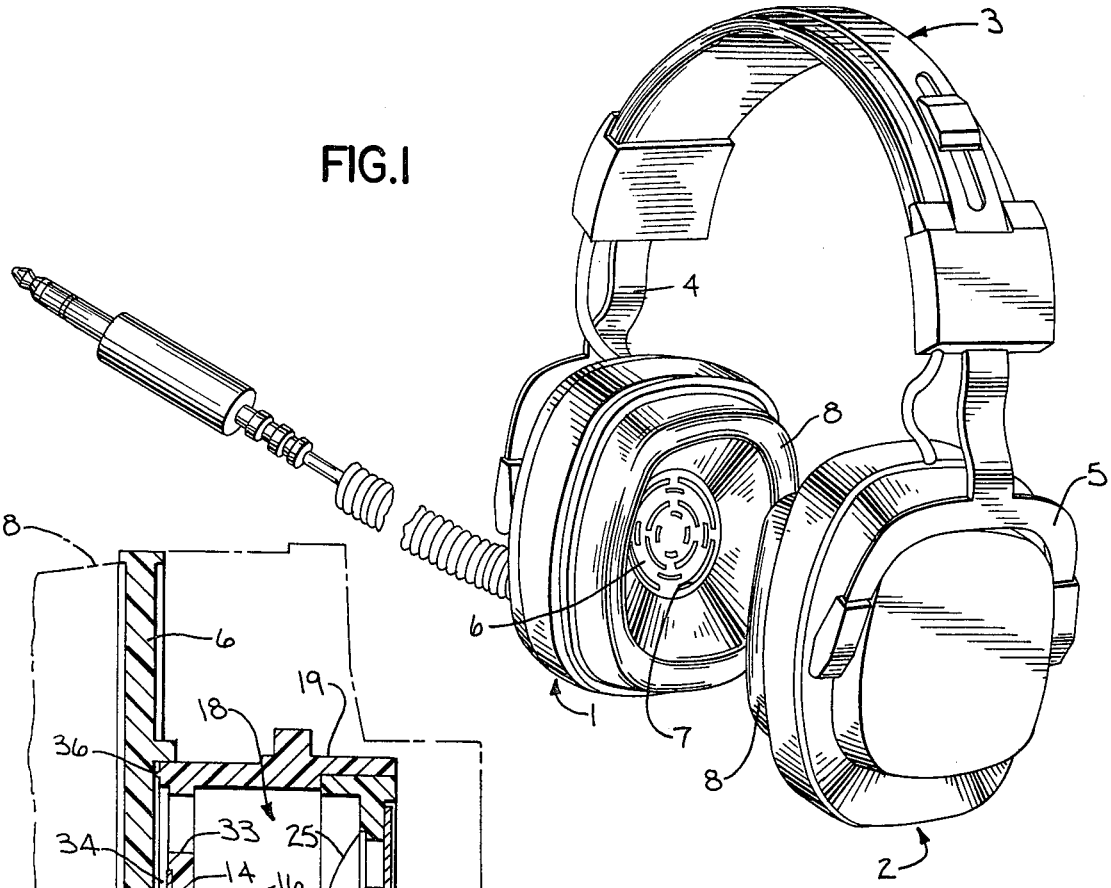
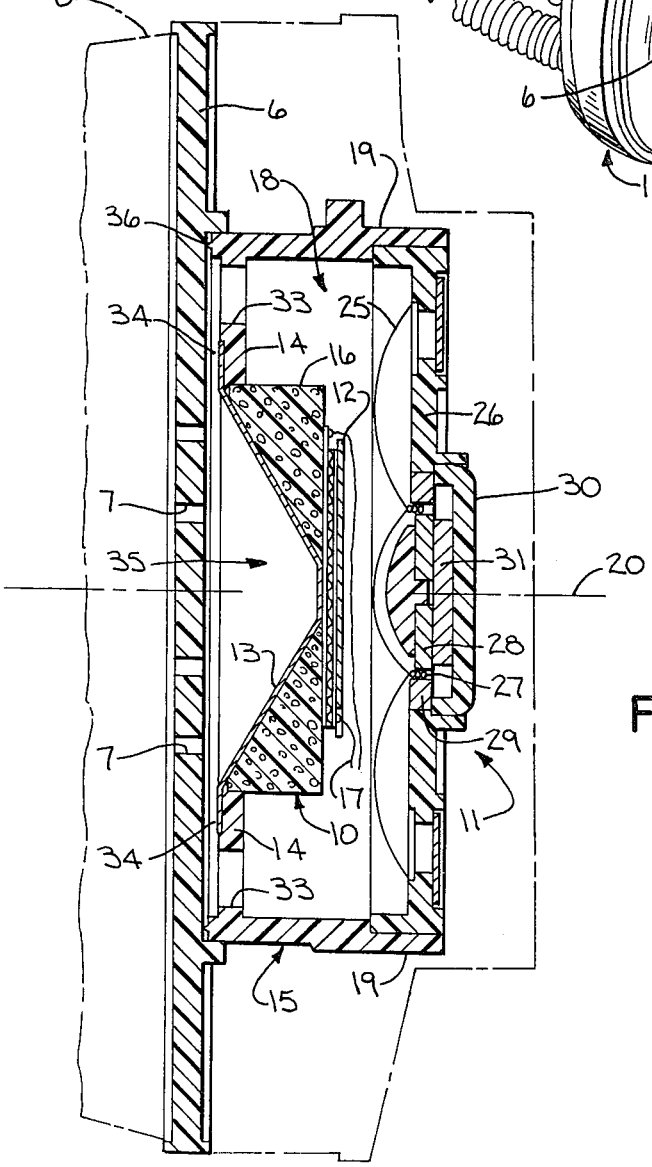
FIG.2

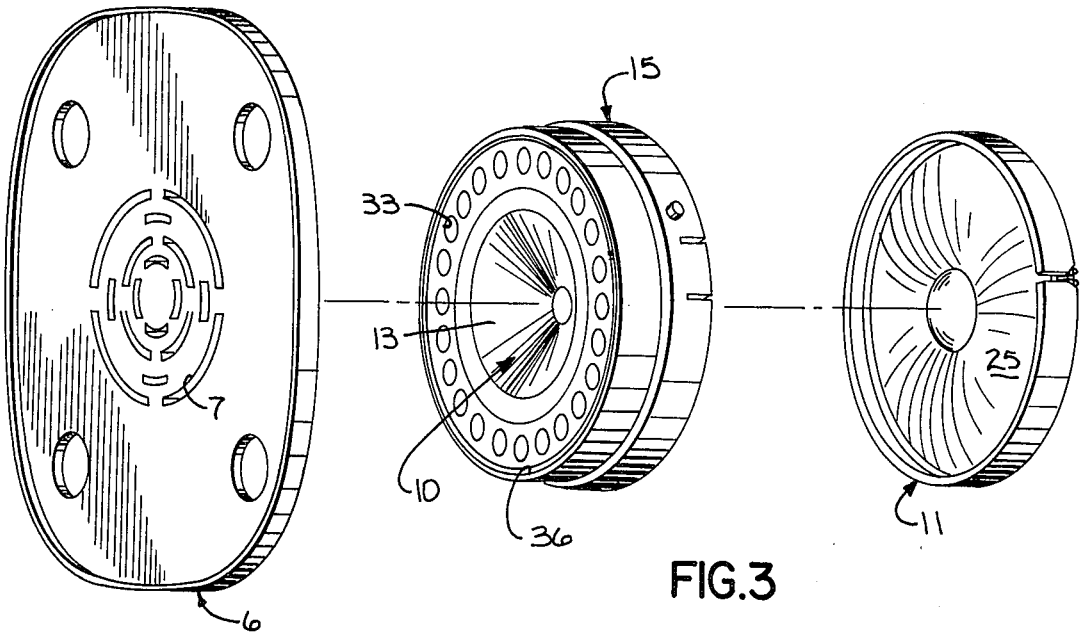
FIG.3
FIG.4
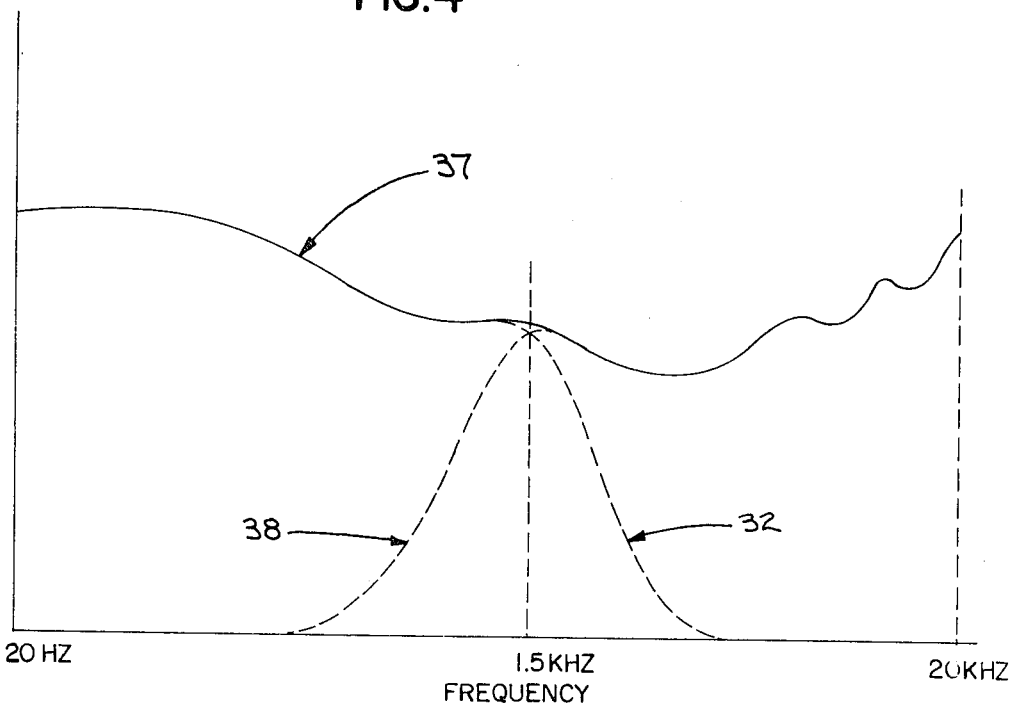

DUAL ELEMENT HEADPHONE

BACKGROUND OF THE INVENTION

The field of the invention is headphones, and particularly, high quality headphones which are produced for the high fidelity market.

One of the most difficult problems of designing a headphone, or stereophone, is to provide an acoustic transducer which will faithfully reproduce frequencies over the entire audio spectrum. When a single acoustic transducer is employed in each ear cup assembly, compromises are made either in its low frequency or high frequency response. For this reason manufacturers typically offer a family of stereophones in which these compromises are varied to provide sounds which conform to the tastes of different listener groups.

The designers of loudspeakers have long recognized the need for more than a single acoustic transducer to reproduce the entire audio spectrum. Quality loudspeakers may contain from two to five separate acoustic transducers, each designed to operate over a specific portion of the audio spectrum. Crossover networks are employed to distribute the applied audio signal to the proper acoustic transducer and these typically include circuits comprised of resistors, capacitors and inductors.

Prior attempts at providing more than one acoustic transducer in a headphone cup assembly have not been successful. When two dynamic transducers have been employed the size and weight of the headphone becomes excessive, particularly when a crossover network is used. Electrostatic transducers have been used in combination with dynamic transducers, but these require expensive and cumbersome high voltage power supplies and crossover networks.

SUMMARY OF THE INVENTION

The present invention relates to a headphone which contains a plurality of acoustic transducers in each cup assembly and in which mechanical means provide the crossover between them. More specifically, the invention includes a headphone cup assembly containing a first acoustic transducer mounted adjacent the back of the cup assembly and being designed to reproduce frequencies at the low end of the audio spectrum, a second acoustic transducer mounted toward the front of the cup assembly to direct sound forward through sound openings in the cup assembly and being designed to reproduce frequencies at the high end of the audio spectrum, and openings disposed around the periphery of the second acoustic transducer to enable sound from the first acoustic transducer to reach the sound openings and being dimensioned to filter sound in the high end of the audio spectrum to thereby provide a mechanical crossover.

A general object of the invention is to provide a light weight and relatively inexpensive dual element headphone. No electrical crossover network is required, thus reducing the cost, size and weight of the headphone. In addition, by employing a piezoelectric transducer as the second acoustic transducer, a relatively small and light weight headphone construction is possible.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIG. 1 is a perspective view of stereophones which employ the present invention, FIG. 2 is a view in cross section through one of the cup assemblies in FIG. 1, FIG. 3 is an exploded perspective view of a portion of the cup assembly of FIG. 2, and FIG. 4 is a graph which illustrates the frequency response of the headphone of FIG. 1 and its separate acoustic transducers.

DESCRIPTION OF THE PREFERRED EMBODIMENT

Referring particularly to FIG. 1, the headphone of the present invention includes a pair of cup assemblies 1 and 2 which are each connected to the ends of a headband 3 by respective yokes 4 and 5. Each cup assembly includes a face plate 6 having sound openings 7 which are directed inward. A cushion 8 is fastened to the face plate 6 and disposed around the sound openings 7. The preferred embodiment described herein is a closed, or pressure, headphone in which the cushions 8 provide a seal around the user's ears and the back of the cup assemblies 1 and 2 fully enclose the acoustic transducers which are contained therein. The present invention is not, however, limited to such closed headphones and the invention may be employed in "open" headphones such as that described in co-pending U.S. patent application Ser. No. 109,504 which was filed on Jan. 4, 1980 and which is entitled "Headphone Construction".

Referring particularly to FIGS. 2 and 3, each cup assembly 1 and 2 includes a dual element transducer comprised of a piezoelectric transducer 10 and a moving coil, dynamic transducer 11. The piezoelectric transducer is a commercially available unit such as that described in U.S. Pat. Nos. 3,786,202 and 2,548,116 and it includes a disk shaped piezoelectric element 12 with a conically shaped diaphragm 13 attached to its front surface. The diaphragm 13 is bonded to the front wall 14 of a molded plastic housing 15 and it is directed towards the sound openings 7 in the ear plate 6. An open cell acoustic foam material 16 encircles the diaphragm 13 from its back side and a pair of wires 17 connect the piezoelectric element to an audio signal source. The piezoelectric transducer 10 operates at relatively high frequencies and does not reproduce significant sound levels at frequencies below approximately 1000 Hertz. The transducer 10 thus has an inherent low frequency cutoff as illustrated more specifically by the curve 38 in FIG. 4.

As shown best in FIGS. 2 and 3, the front wall 14 which supports the piezoelectric transducer 10 is circular in shape and extends completely around the rim of the transducer diaphragm 13. The housing 15 extends rearward from the periphery of the front wall 14 to define a circular cylindrical cavity 18 behind the piezoelectric transducer 10. This cavity 18 is enclosed by the dynamic transducer 11 which extends across its entire back side and which is bonded to a flange 19 that is integrally molded to the back of the housing 15. The acoustic transducers 10 and 11 are thus mounted coaxially along a common sound emitting axis 20 with an enclosed cavity 18 formed between them.

The dynamic transducer 11 includes a molded plastic diaphragm 25 which is bonded to a molded plastic disc 26 around its entire outer perimeter. The diaphragm 25 supports a voice coil 27 which is disposed in a circular air gap formed between an inner pole piece 28 and an outer pole piece 29. The pole pieces 28 and 29 are formed from a ferromagnetic material and form part of a magnetic circuit which also includes a metal retainer cap 30 and a disc-shaped permanent magnet 31. The voice coil 27 is connected to the same acoustic signal source as the wires 17, and in response thereto, the voice coil 27 drives the diaphragm 25 to produce sound. The resonant frequency of the dynamic transducer 11 is approximately 200 Hertz and its frequency response is indicated by curve 32 in FIG. 4.

Referring particularly to FIGS. 2 and 3, the sound generated by the dynamic transducer 11 is coupled to the enclosed cavity 18. This sound reaches the ear of the user through a series of circular openings, or ports 33 which are formed in the forward wall 14 and which encircle the piezoelectric transducer 10. The face plate 6 which contains the sound openings that lead to the user's ear is fastened to the front of the wall 14 and spaced slightly forward therefrom. A constricted sound passage, or channel 34, is thus formed between the face plate 6 and the front wall 14, and it is through this channel 34 that sound flows from the ports 33 to a cavity 35 in front of the piezoelectric transducer 10. Sound produced by the dynamic transducer 11 thus passes through the cavity 18, the ports 33, radially inward toward the sound emitting axis 20 through the constricted passage 34, and then through the cavity 35 and sound openings 7 to the user's ear. This sound path operates as a low-pass filter, and by adjusting the spacing between the face plate 7 and the forward wall 14, the frequency at which this filter attenuates, or "rolls off", the frequency response of the dynamic transducer 11 can be set. In the preferred embodiment this spacing is provided by a 0.006 inch bead 36 which attenuates the output of transducer 11 at approximately 1500 Hertz.

Referring particularly to FIG. 4, the frequency response of the headphone is the sum of the outputs from both acoustic transducers 10 and 11. This is indicated by the curve 37 which is the sum of the response curves 38 and 32 produced by the respective acoustic transducers 10 and 11. In the preferred embodiment a crossover frequency of approximately 1500 Hertz is thus achieved without the use of electrical components.

It should be apparent that many variations can be made in the structure disclosed herein without departing from the spirit of the invention. The piezoelectric transducer is particularly useful in this structure because of its size, weight and cost, and because it has a natural low frequency cut-off which allows the audio spectrum to be judiciously divided into two parts. Although other physical structures will also provide the constricted sound passages needed to form a low-pass filter for the low frequency transducer, the coaxial mounting of the transducers 10 and 11 in a housing which is attached to the face plate 6 is particularly compact and light weight.

I claim:

1. In a headphone having a cup assembly with sound openings, the combination comprising:

a first acoustic transducer mounted within the cup assembly and positioned to direct sound through the sound openings, the first acoustic transducer having a cut-off frequency below which its acoustic output is substantially attenuated;

a housing which defines a cavity and a constricted passage which acoustically couples the cavity to the sound openings; and a second transducer mounted to the housing and positioned to direct sound into the cavity, the second transducer having a resonant frequency below the cut-off frequency of the first acoustic transducer and being operable to provide substantial acoustic output below that cut-off frequency, wherein the constricted passage is constructed to attenuate the acoustic output of the second acoustic transducer above a selected roll-of frequency, and in which the first acoustic transducer is fastened to a front wall on the housing and the housing is fastened to a face plate which contains the sound openings such that the acoustic output of the first acoustic transducer is directed through the sound openings, and in which ports are formed in the front wall of the housing around the periphery of the first acoustic transducer and the acoustic output of the second acoustic transducer is coupled to the sound openings through the ports.

2. The headphone as recited in claim 1 in which the face plate is positioned over the ports and spaced from the front wall of the housing to form the constrictions through which sound emanating from the second acoustic transducer flows to reach the sound openings.

3. The headphone as recited in claim 1 in which the first acoustic transducer is a piezoelectric acoustic transducer.

* * * * *

UNITED STATES PATENT AND TRADEMARK OFFICE

CERTIFICATE OF CORRECTION

PATENT NO. : 4,418,248

DATED : November 29, 1983

INVENTOR(S) : Terry D. Mathis

It is certified that error appears in the above—identified patent and that said Letters Patent is hereby corrected as shown below:

Column 2, line 43, "2,548,116" should read ---3,548,116---

Signed and Sealed this

*Twenty-fourth* Day of *April 1984*

[SEAL]

*Attest:*

GERALD J. MOSSINGHOFF

*Attesting Officer*

*Commissioner of Patents and Trademarks*